US009651247B2

(12) United States Patent
Scheuring, III et al.

(10) Patent No.: US 9,651,247 B2
(45) Date of Patent: May 16, 2017

(54) VENTURI HOUSING ASSEMBLY AND METHOD

(75) Inventors: Joseph Felix Scheuring, III, Richmond Hill (CA); Paulo Jorge Rosa, Etobicoke (CA); David Popowich, Brampton (CA)

(73) Assignee: GARLAND COMMERCIAL INDUSTRIES L.L.C., Freeland, PA (US)

( * ) Notice: Subject to any disclaimer, the term of this patent is extended or adjusted under 35 U.S.C. 154(b) by 346 days.

(21) Appl. No.: 12/287,654

(22) Filed: Oct. 10, 2008

(65) Prior Publication Data

US 2009/0142719 A1 Jun. 4, 2009

Related U.S. Application Data

(60) Provisional application No. 60/998,377, filed on Oct. 10, 2007.

(51) Int. Cl.

| | |
|---|---|
| ***F23D 14/70*** | (2006.01) |
| ***F23D 14/04*** | (2006.01) |
| ***F23D 14/08*** | (2006.01) |
| ***F23D 14/10*** | (2006.01) |

(52) U.S. Cl.

CPC ..... *F23D 14/04* (2013.01); *F23D 14/08* (2013.01); *F23D 14/085* (2013.01); *F23D 14/10* (2013.01); *F23D 14/70* (2013.01)

(58) Field of Classification Search

CPC ..... F23D 14/04; F23D 14/08; F23D 14/10; F23D 14/70; F23D 14/085

USPC ..... 126/39 R, 39 A; 431/278, 349, 354

See application file for complete search history.

(56) References Cited

U.S. PATENT DOCUMENTS

| | | | | |
|---|---|---|---|---|
| 3,285,240 | A | 11/1966 | Schmidt | 126/91 |
| 4,779,606 | A * | 10/1988 | Vanderman | 126/39 E |
| 5,567,147 | A | 10/1996 | Fenn et al. | |
| 6,851,420 | B2 | 2/2005 | Jennings | 126/39 R |
| 7,811,082 | B2 | 10/2010 | Czajka et al. | |
| 2006/0063119 | A1 * | 3/2006 | Molla | F23D 14/70 431/354 |
| 2006/0147861 | A1 * | 7/2006 | Czajka et al. | 431/278 |
| 2008/0160465 | A1 | 7/2008 | Pryor et al. | |

FOREIGN PATENT DOCUMENTS

| | | | |
|---|---|---|---|
| DE | 8710016.9 | U1 | 11/1988 |
| KR | 1020040040577 | A | 5/2004 |

OTHER PUBLICATIONS

International Search Report dated Dec. 12, 2008 issued in the corresponding International Application No. PCT/US2008/011691. Fourth Office Action dated Apr. 17, 2014 for corresponding Chinese patent application No. 200880115468.8 with English translation, pp. 16.

(Continued)

*Primary Examiner* — Jorge Pereiro

(74) *Attorney, Agent, or Firm* — Ohlandt, Greeley, Ruggiero & Perle, L.L.P.

(57) ABSTRACT

A venturi housing assembly having a horizontal wall that is cast as part of the venturi housing assembly. A plurality of gas/air release openings are cast into the horizontal wall that gradually provide a balanced mix of gas and air to one or more burner heads and release the gas and air mixture in order to provide an even heat pattern.

15 Claims, 2 Drawing Sheets

(56) References Cited

OTHER PUBLICATIONS

Canadian Patent Office action dated May 8, 2014 from corresponding Canadian Patent Application No. 2,701,829, pp. 2.
Office Action Issued Mar. 23, 2012 in Corresponding Canadian Application No. 2,701,829.
Extended European Search Report Issued Nov. 16, 2011 in Corresponding EP08838283.3.
International Preliminary Report on Patentability Issued Dec. 5, 2010 in Corresponding PCT/US08/11691.
Office Action Issued Feb. 29, 2012 in Corresponding Chinese Application No. 200880115468.8.
Office Action Issued Jul. 6, 2011 in Corresponding Australian Application No. 2008311275.
Office Action dated Jul. 31, 2012 corresponding to European Patent Application No. 08838283.3.
Canadian Patent Office action dated Aug. 23, 2013 from corresponding Canadian Patent Application No. 2,701,829 pp. 3.
Canadian Office Action dated Dec. 3, 2012 from corresponding Canadian Patent Application No. 2701829, 2 pages.
Office Action issued by Chinese Patent Office on Nov. 4, 2014 for corresponding Chinese Patent Application No. 200880115468.8, pp. 9.
Second Office Action and Search Report dated Jan. 21, 2013 for corresponding Chinese patent application No. 200880115468.8 with English translation, pp. 19.
Chinese Office Action dated Oct. 10, 2013 for Chinese application No. 200880115468.8.

* cited by examiner

VENTURI HOUSING ASSEMBLY AND METHOD

RELATED APPLICATION

This application claims the priority of U.S. Provisional Application Ser. No. 60/998,377 filed Oct. 10, 2007, the entire contents of which are hereby incorporated herein.

BACKGROUND OF THE INVENTION

1. Field of the Invention

The present disclosure relates to a method and a venturi housing assembly that delivers a mixture of gas and air to one or more burner heads.

2. Description of Related Art

A venturi housing assembly is used to combine gas and air components into a mixture and to deliver the mixture to a burner or pilot. As used herein, the term "venturi housing assembly" refers to and includes any venturi, injector or similar device wherein a gas and air mixture flows therein.

Traditional venturi housing assemblies are manufactured with a horizontal wall that can be cast into the housing assembly. The horizontal wall functions to choke off the gas and air mixture and to define the release point for the gas and air mixture from the venturi assembly. However, the horizontal wall is traditionally manufactured so that the gas and air mixture is released in one large quantity at the end of the horizontal wall, which results in a hot spot from the burner head and uneven heat pattern. The horizontal wall does not provide a way to gradually release the mixture of gas and air. As a result, a traditional venturi housing assembly can only accommodate a single burner head design because the positioning of the horizontal wall is customized and optimized for a particular burner head.

There is a need for a method and a venturi housing assembly that provides a more balanced and gradual release of the gas and air mixture throughout the entire burner head.

There is also a need for a venturi housing assembly that can use one or more interchangeable burner heads.

SUMMARY OF THE INVENTION

The present disclosure provides a venturi housing assembly with a horizontal wall that can be cast into the assembly that provides a balanced mixture of gas and air to a burner head so as to provide an even heat pattern from the burner head.

A venturi housing assembly of the present disclosure comprises a venturi assembly that comprises a horizontal wall and at least one gas/air release opening in the horizontal wall. The opening is shaped to gradually provide a balanced mix of gas and air to exit ports of a burner head so as to provide an even heat pattern from the burner head.

In one embodiment of the venturi housing assembly of the present disclosure, the opening is one of a plurality of openings in the horizontal wall spaced to provide the balanced mix of gas and air to the exit ports of the burner head.

In another embodiment of the venturi housing assembly of the present disclosure, the plurality of gas/air release openings is in the range of about two to about six openings.

In another embodiment of the venturi housing assembly of the present disclosure, each of the gas/air release openings has a diameter in a range of about 3/16 of an inch to about 3/8 of an inch.

In another embodiment of the venturi housing assembly of the present disclosure, a shape of the openings is selected from the group consisting of: a circle, a square, a triangle, a slit and any combinations thereof that releases the gas and air mixture in a controlled fashion to the exit ports in the burner head in a consistent, even and predictable manner.

In another embodiment of the venturi housing assembly of the present disclosure, the burner head is selected from the group consisting of: a star head burner, octagonal burner head and donut burner head.

In another embodiment of the venturi housing assembly of the present disclosure, an injector injects a mixture of gas and air through an air shutter and a throat to the horizontal wall.

In another embodiment of the venturi housing assembly of the present disclosure, the plurality of gas/air release openings is in a range of about two to about six openings.

In another embodiment of the venturi housing assembly of the present disclosure, each of the gas/air release openings has a diameter in a range of about 1/4 of an inch to about 1/3 of an inch.

In another embodiment of the venturi housing assembly of the present disclosure, the gas/air release openings are drilled, machined, or cast in the horizontal wall.

A method of the present disclosure supplies an air/gas mixture to exit ports of a burner head that sits over a horizontal wall. The method comprises supplying the air/gas mixture to the horizontal wall via a venturi and distributing the air/gas mixture to the exit ports via at least one opening in the horizontal wall. The opening is shaped to gradually provide a balanced mix of gas and air to the exit ports of the burner head so as to provide an even heat pattern from the burner head.

In one embodiment of the method of the present disclosure, the opening is one of a plurality of openings in the horizontal wall spaced to provide the balanced mix of gas and air to the exit ports of the burner head.

In another embodiment of the method of the present disclosure, the plurality of gas/air release openings is in a range of about two to six about openings.

In another embodiment of the method of the present disclosure, each of the plurality of gas/air release openings has a diameter in a range of about 3/16 of an inch to about 3/8 of an inch.

In another embodiment of the method of the present disclosure, a shape of the openings is selected from the group consisting of: a circle, a square, a triangle, a slit and any combinations thereof that releases the gas and air mixture in a controlled fashion to the exit ports in the burner head in a consistent, even and predictable manner.

DETAILED DESCRIPTION OF THE INVENTION

Figure 1:
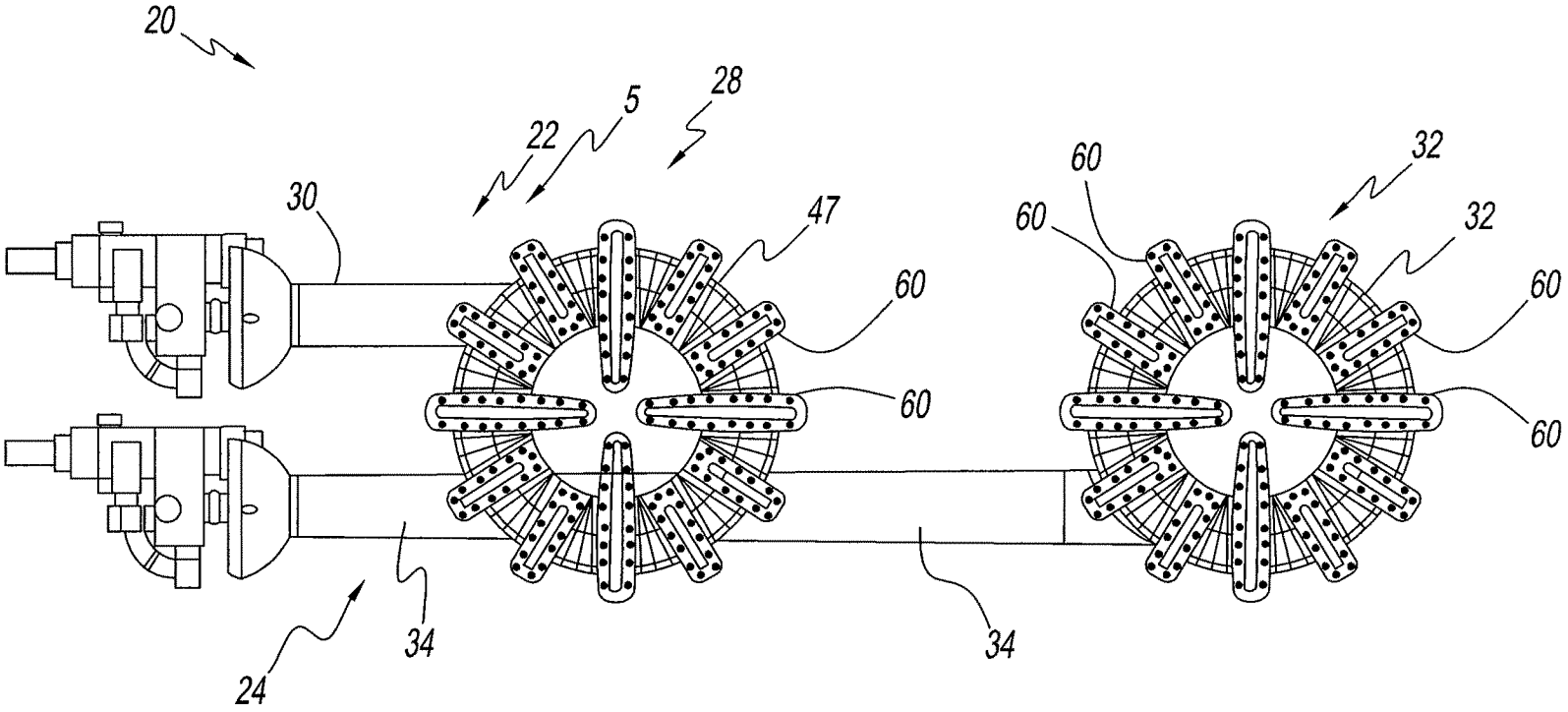
FIG. 1 is a top view of the venturi housing assembly of the present disclosure.
Figure 2:
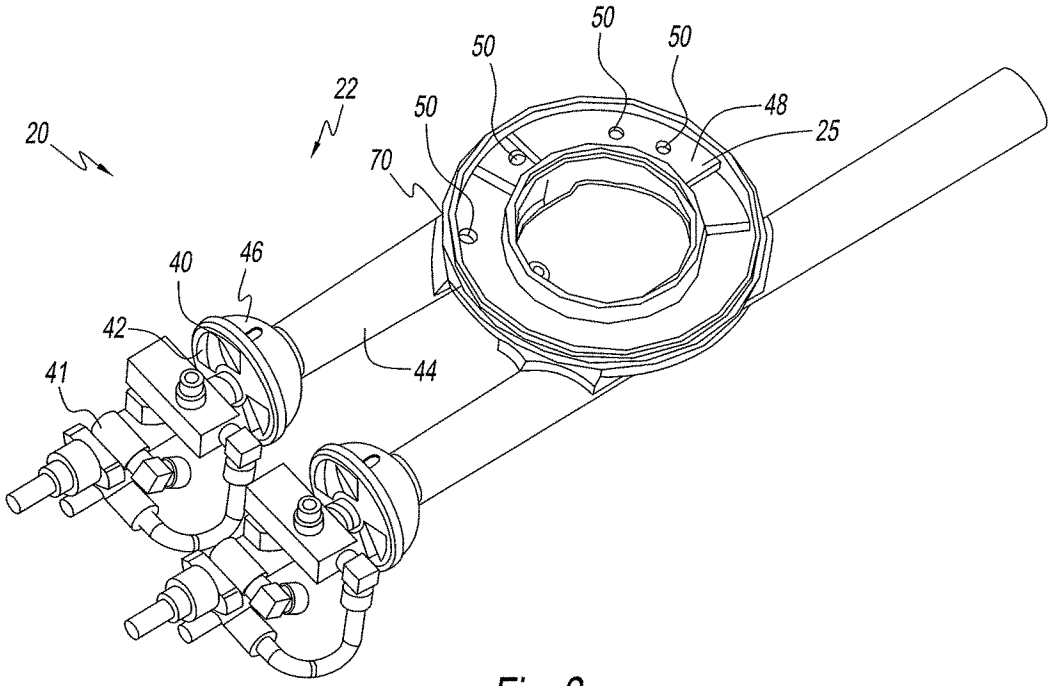
FIG. 2 is a top front perspective view of the front venturi assembly of the venturi housing assembly of FIG. 1 with the burner head removed.

Referring to FIG. 1, a venturi housing assembly 20 comprises a front venturi assembly 22 and a rear venturi assembly 24. Front venturi assembly 22 comprises a front burner 28 and a front venturi 30. Rear venturi assembly 24 comprises a rear burner 32 and a rear venturi 34. Front venturi assembly 22 and rear venturi assembly 24 are substantially identical so that only front venturi assembly 22 will be described in detail. Referring to FIGS. 1 and 2, front venturi assembly 22 comprises an air shutter 40 that covers a bell section 46 of the venturi 30. Air shutter 40 supports and centers injector 42 and allows for the entry of primary air that is drawn into venturi housing assembly 22 as a result of the venturi effect, which occurs when gas is injected into venturi assembly 22. A valve 41 allows for the flow of gas through the injector 42. The gas and air begin to mix together in a bell 46. The gas and air mixture travels into a throat section 44 that further mixes the gas and air. The gas and air mixtures, for example, may include one or more supply gases including, but not limited to, manufactured gases, propane, natural gas, butane, liquefied natural gas and any combinations thereof.

As shown in FIGS. 1 and 2, front burner 28 comprises an annular burner head 46 that sits over an annular horizontal wall 48 and provides an annular chamber in which to receive the gas and air mixture that flows in venturi housing assembly 22. Annular horizontal wall 48 receives at an entry point 70 the air/gas mixture from throat section 44. Annular horizontal wall 48 controls the mixture because by stretching the wall, the air/gas mixture is forced to travel further before it is allowed to fill the chamber of the burner head 47 giving it more time to mix. This is beneficial as the better the mixture, the better the combustion. In another exemplary embodiment, horizontal wall 48 is cast into venturi housing assembly 22.

Front venturi assembly 22 comprises a plurality of gas/air release openings 50 that are drilled, machined or cast into horizontal wall 48. Gas/air release openings 50 are designed to release the gas and air mixture gradually and evenly towards one or more exit ports 60 within burner head 47 in order to achieve an even flame pattern in the burner. The resulting even flame pattern provided by gas/air release openings 50 assures that there are no hot or cold spots on the burner. The placement of gas/air release openings 50 on horizontal wall 48 can be varied to achieve a resulting even flame pattern.

The size of gas/air release openings 50 can range in diameter from about 1/32 of an inch up to the entire width of horizontal wall 48. In an exemplary embodiment, the diameter size of gas/air release openings 50 is in a range from about 3/16 of an inch to about 3/8 of an inch.

In addition, gas/air release openings 50 can be any shape including a circle, a square, a triangle, a slit, a slot, or any other shape that releases the gas and air mixture in a controlled fashion to the exit ports in the one or more burner heads in a consistent, even and predictable manner. In an exemplary embodiment, gas/air release openings 50 can be a slot that is machined from one end of horizontal wall 48 to the other side of horizontal wall 48. In another exemplary embodiment, gas/air release openings 50 can be a plurality of slits that are cut into horizontal wall 48. The number of slits and the space in between the slits can be varied to assure that the gas and air mixture is released in a controlled fashion in a consistent, even and predictable manner. This is in contrast to the typical known venturi assemblies in which all of the gas comes out at the end of the horizontal wall. This results in more gas being available for the exit ports directly above the end of the horizontal wall than is available at distances progressively away from the end of the horizontal wall. Thus, when the burner head is lit, some of the flames are actually higher than others, which result in the hot spot that is mentioned in the background section. In contrast openings 50 in horizontal wall 48 serve to even out the gas distribution so that the same amount of gas is available to all ports 60 of burner head 46 so as to provide an even heat pattern.

Venturi housing assembly 22 as constructed with gas/air release openings 50 can be used with one or more interchangeable burner heads and still maintain the gradual release of the gas and air mixture while further providing a resulting even flame pattern. Test results have also demonstrated that venturi housing assembly 22 can pass regulatory tests with each of the one or more burner heads matched to the system.

Table 1 below provides open single burner testing results for a first exemplary embodiment unit and a second exemplary embodiment unit of venturi housing assembly 20 of the present disclosure. The first exemplary embodiment utilized venturi housing assembly 20 in conjunction with a star head burner 46. The second exemplary embodiment utilized an octagonal burner head 46 in conjunction with the same venturi housing assembly 20 from the first exemplary unit. Table 1 further provides open burner testing results for four other traditional venturi housing assemblies that do not have openings in the horizontal wall for the gradual release of the gas and air mixture. In addition to these tests, three cooking evenness tests were run for each burner (flour, water, pancake batter). The test data shows that the burners on the first exemplary embodiment and the second exemplary embodiment of venturi housing assembly 5 of the present disclosure provided the most even cooking results.

TABLE 1

Statistic Values for Open Burner Testing

| | Test unit 1 with Openings | Test unit 2 with Openings | Competitor Unit 1 | Competitor Unit 2 | Competitor Unit 3 | Competitor Unit 4 |
|---|---|---|---|---|---|---|
| Average Overall Evenness | 30.7° F. | 35.7° F. | 37.4° F. | 58.4° F. | 53.2° F. | 29.3° F. |
| I/O Average | 51.5° F. | 89.1° F. | 63.5° F. | 155.4° F. | 128.3° F. | 21.4° F. |
| L/R Average | 15.0° F. | 3.6° F. | 41.5° F. | 8.2° F. | 17.0° F. | 35.0° F. |
| F/B Average | 25.7° F. | 14.5° F. | 7.2° F. | 11.6° F. | 13.3° F. | 31.5° F. |
| 500 Time | 329 seconds | 345 seconds | 310 seconds | 291 seconds | 374 seconds | 407 seconds |
| SS Temp | 909° F. | 916° F. | 934° F. | 906° F. | 870° F. | 839° F. |
| Average | 11.5 | 17.4 | 14.3 | 11.2 | 11.8 | 7.6 |
| I/O Average | 7.2° F. | 22.0° F. | 28.5° F. | 26.5° F. | 31.6° F. | 13.5° F. |
| L/R Average | 10.5° F. | 16.3° F. | 13.8° F. | 0.8° F. | 0.9° F. | 3.9° F. |
| F/B Average | 16.9° F. | 13.9° F. | 0.7° F. | 6.2° F. | 2.9° F. | 5.5° F. |
| SS Temp | 321° F. | 299° F. | 494° F. | 269° F. | 310° F. | 580° F. |

TABLE 1-continued

| Statistic Values for Open Burner Testing | | | | | | |
|---|---|---|---|---|---|---|
| | Test unit 1 with Openings | Test unit 2 with Openings | Competitor Unit 1 | Competitor Unit 2 | Competitor Unit 3 | Competitor Unit 4 |
| Combustion % AFCO | 0.010 @ 32.9K | 0.010 @ 32.9K | N/A | N/A | N/A | N/A |
| Efficiency | 43.5% | 43.1% | 43.2% | 45.3% | 41.2% | 40.6%. |
| Boiling Time | 33' 15" | 35' 58" | 35' 30" | 31' 07" | 39' 29" | 37' 22" |

The tests for evenness used a standard ASTM 12-inch diameter, ¼-inch thick thermal test plate with seventeen thermocouples placed in prescribed spots (one in the center, eight in a middle ring, and eight in an outer ring). The plate was run for thirty minutes on a high heat setting and for one hour on a simmer heat setting to gather the evenness data.

The I/O average data denotes the average difference between the thermocouples in the center versus the outer ring of thermocouples. The higher numbers signify a poorer evenness when comparing the inner ring versus the outer ring.

The L/R average data denotes the average difference between the thermocouples on the left side of the thermal plate versus those on the right side of the thermal plate. The higher numbers signify a poorer evenness when comparing the left side versus the right side of the ring.

The F/B data denotes the average difference between the thermocouples on the front half of the thermal plate versus the back half of the thermal plate. The higher numbers signify a poorer evenness when comparing the front side versus the back side of the ring.

The data in Table 1 supports that the overall performance of venturi housing assembly 5 is improved vis-à-vis the traditional venturi assemblies of the competitor units used in the test. The first exemplary embodiment unit and the second exemplary embodiment unit of venturi housing assembly 20 of the present disclosure demonstrated optimal performance in regard to evenness of heat and boil time. The overall evenness is the average of the I/O data, L/R data and F/B data. The lower numbers signify improved and optimal performance. Thus, the test data shows that the burners of the first and second test embodiments provide the most even cooking results.

From the present invention having been thus described with particular reference to the preferred forms thereof, it will be obvious that various changes and modifications may be made therein without departing from the spirit and scope of the present invention as defined in the appended claims.

What is claimed is:

1. A venturi housing assembly comprising:

an annular burner head having an upper surface with a plurality of exit ports distributed about said upper surface;

a first annular chamber below said annular burner head and in fluid communication with said plurality of exit ports;

a second annular chamber;

an annular horizontal wall that is disposed between said first annular chamber and said second annular chamber and that has a plurality of air/gas release openings providing fluid communication between said first annular chamber and said second annular chamber;

a venturi that provides an air/gas mixture to said second annular chamber via an entry point; and wherein said air/gas release openings in said annular horizontal wall are spaced to provide a balanced mix of gas and air to said exit ports of said annular burner head, and wherein said air/gas release openings are shaped and distributed along said annular horizontal wall away from said entry point to force said air/gas mixture to travel around said annular chamber and provide more time and distance to mix and to even out said air/gas mixture to said exit ports of said annular burner head so as to provide an even heat pattern from said annular burner head.

2. The venturi housing assembly of claim 1, wherein said plurality of air/gas release openings is in a range of two to six air/gas release openings.

3. The venturi housing assembly of claim 1, wherein each of said plurality of air/gas release openings has a diameter in a range of 3/16 of an inch to ⅜ of an inch.

4. The venturi housing assembly of claim 1, wherein said air/gas release openings have a shape that is selected from the group consisting of: a circle, a square, a triangle, and a slit, and wherein said air/gas release openings release the gas and air mixture in a controlled fashion to said exit ports in said burner head in a consistent, even and predictable manner.

5. The venturi housing assembly of claim 1, wherein said annular burner head is selected from the group consisting of: a star head burner and octagonal burner head.

6. The venturi housing assembly of claim 1, further comprising an injector that injects a mixture of gas and air through an air shutter and a throat to said entry point of said second annular chamber.

7. The venturi housing assembly of claim 6, wherein the plurality of air/gas release openings are in a range of two to six openings.

8. The venturi housing assembly of claim 6, wherein each of said plurality of air/gas release openings has a diameter in a range of ¼ of an inch to ⅓ of an inch.

9. The venturi housing assembly of claim 1, wherein said air/gas release openings are drilled, machined, or cast in said annular horizontal wall.

10. The venturi housing assembly of claim 1, wherein said spacing between said air/gas release openings is varied.

11. A method of supplying an air/gas mixture to a plurality of exit ports through an upper surface of an annular burner head that sits over a first annular chamber that is in fluid communication, via an annular horizontal wall that has plurality of air/gas release openings, with a second annular chamber that is disposed below said first annular chamber and that has an entry point, said method comprising:

supplying said air/gas mixture to said first annular chamber with a venturi via said entry point; and distributing said air/gas mixture to said second annular chamber via said plurality of air/gas release openings wherein said air/gas release openings are spaced to provide a balanced mix of gas and air to said exit ports of said annular burner head, and wherein said air/gas release openings are shaped and distributed along said annular horizontal wall away from said entry point so that said air/gas mixture travels around said first annular chamber and then around said second annular chamber, and provides more time and distance to mix and to even out said air/gas mixture to said exit ports of said annular burner head so as to provide an even heat pattern from said annular burner head.

12. The method of claim 11, wherein said plurality of air/gas release openings is in a range of two to six air/gas release openings.

13. The method of claim 11, wherein each of said plurality of air/gas release openings has a diameter in a range of 3/16 of an inch to 3/8 of an inch.

14. The method of claim 11, wherein a shape of said air/gas release openings is selected from the group consisting of: a circle, a square, a triangle, a slit and any combinations thereof that releases the gas and air mixture in a controlled fashion to said exit ports in said burner head in a consistent, even and predictable manner.

15. The method of claim 11, wherein said spacing between said air/gas release openings is varied.

* * * * *